US009230707B2

(12) United States Patent
Chung et al.

(10) Patent No.: US 9,230,707 B2
(45) Date of Patent: Jan. 5, 2016

(54) PRODUCTION METHOD FOR A TRANSPARENT CONDUCTIVE FILM AND A TRANSPARENT CONDUCTIVE FILM PRODUCED THEREBY

(75) Inventors: Kwang Choon Chung, Yongin-si (KR); Hyun-Nam Cho, Gunpo-si (KR); Ji Hoon Yoo, Bucheon-si (KR); Yun-Ho Jung, Ansan-si (KR)

(73) Assignee: Inktec Co., Ltd., Kyeongki-do (KR)

( * ) Notice: Subject to any disclaimer, the term of this patent is extended or adjusted under 35 U.S.C. 154(b) by 241 days.

(21) Appl. No.: 13/813,247

(22) PCT Filed: Jul. 28, 2011

(86) PCT No.: PCT/KR2011/005564

§ 371 (c)(1),
(2), (4) Date: Jan. 30, 2013

(87) PCT Pub. No.: WO2012/015254

PCT Pub. Date: Feb. 2, 2012

(65) Prior Publication Data

US 2013/0126796 A1 May 23, 2013

(30) Foreign Application Priority Data

Jul. 30, 2010 (KR) ..... 10-2010-0074380

(51) Int. Cl.
*H01B 1/02* (2006.01)
*H01B 1/08* (2006.01)
*H01B 1/22* (2006.01)

(52) U.S. Cl.
CPC .. *H01B 1/08* (2013.01); *H01B 1/02* (2013.01); *H01B 1/22* (2013.01)

(58) Field of Classification Search
CPC ..... H01B 1/02; H01B 1/08; H01B 1/124
USPC ..... 252/514, 518.1
See application file for complete search history.

(56) References Cited

U.S. PATENT DOCUMENTS

| | | | | |
|---|---|---|---|---|
| 5,525,578 | A * | 6/1996 | Langeluddeke et al. | 504/128 |
| 6,117,366 | A * | 9/2000 | Park et al. | 252/512 |
| 6,712,998 | B2 | 3/2004 | Kato | |
| 8,040,042 | B2 * | 10/2011 | Yukinobu | 313/504 |
| 2008/0223428 | A1 * | 9/2008 | Zeira | 136/244 |
| 2008/0258605 | A1 | 10/2008 | Yukinobu | |

FOREIGN PATENT DOCUMENTS

| | | | |
|---|---|---|---|
| CN | 1846281 | A | 10/2006 |
| JP | 2003213441 | A | 7/2003 |
| KR | 1999011487 | A | 2/1999 |

(Continued)

*Primary Examiner* — Harold Pyon
*Assistant Examiner* — William Young
(74) *Attorney, Agent, or Firm* — The Webb Law Firm

(57) ABSTRACT

Provided is a production method for a transparent conductive film wherein: a substrate has formed thereon a transparent conductive oxide, a conductive metal body, and a conductive polymer comprised in a transparent composite conductive layer; or else a substrate has formed thereon a transparent conductive oxide layer; a conductive metal body layer, and a conductive polymer layer comprised in a transparent composite conductive layer; or a substrate has formed thereon a transparent conductive oxide layer, and also a conductive metal body and a conductive polymer comprised in an organic-inorganic hybrid layer in a transparent composite conductive layer. Also provided is a transparent conductive film produced by means of the method.

5 Claims, 1 Drawing Sheet

(56) References Cited

FOREIGN PATENT DOCUMENTS

| | | | |
|---|---|---|---|
| KR | 19990064113 | A | 7/1999 |
| KR | 20000009405 | A | 2/2000 |
| KR | 1020030043909 | A | 6/2003 |
| KR | 1020050052992 | A | 6/2005 |
| KR | 1020070095919 | A | 10/2007 |
| WO | 2009086161 | A1 | 7/2009 |

* cited by examiner

PRODUCTION METHOD FOR A TRANSPARENT CONDUCTIVE FILM AND A TRANSPARENT CONDUCTIVE FILM PRODUCED THEREBY

TECHNICAL FIELD

The present invention relates to a production method for a transparent conductive film capable of producing a transparent conductive film having excellent conductivity, transmittance, bending resistance, and adhesion, and low haze through a simple process, and a transparent conductive film produced thereby.

BACKGROUND ART

Generally, a transparent conductive layer has been used as an essential component of electric and electronic devices such as a power source in display devices, an electromagnetic wave shielding film in home appliances, a transparent electrode in various display fields such as a liquid crystal display (LCD), an organic light emitting diodes (OLED), a field emission display (FED), a plasma display panel (PDP), a flexible display, an electronic paper, or the like. Currently, as a material of the transparent conductive layer, a conductive inorganic oxide material such as indium-tin oxide (ITO), antimony-tin oxide (ATO), antimony-zinc oxide (AZO), or the like, is mainly used.

The transparent conductive layer having relatively high conductivity and transmittance may be produced using the material by a sputtering method, an ion beam method, a vacuum deposition method, or the like, that are generally used. However, in this method, cost for investing into vacuum equipments is high, and it is difficult to mass-produce the transparent conductive layer and prepare a large size transparent conductive layer. Particularly, this method has a limitation in a transparent substrate requiring a low temperature process, such as a plastic film.

At the time of deposition by the sputtering method, a composition of the transparent conductive layer may be changed according to the conditions such as oxygen partial pressure, a temperature, and the like, and the transmittance and resistance of the thin film may be rapidly changed.

Therefore, a method for producing a transparent conductive film performed by coating a layer using a wet coating method such as a spin coating method, a spray coating method, a dip coating method, a printing method, or the like, which are appropriate for low cost and a large size, and then firing the coated layer, or the like, has been suggested. For example, a transparent conductive layer using a metal fine particle and a binder is disclosed in Korean Patent Laid-Open Publication No. 1999-011487, a composition for a transparent conductive layer in which a hollow carbon nano fiber is added to tin oxide is disclosed in Korean Patent Laid-Open Publication No. 1999-064113, and a coating solution for a transparent conductive light selectively absorbing film in which neodymium oxide is added to tin oxide or indium oxide is disclosed in Korean Patent Laid-Open No. 2000-009405. In addition, a method for preparing a solution for a transparent conductive layer containing a metal particle such as gold, silver, or the like, is disclosed in Japanese Patent Laid-open Publication No. 2003-213441.

A surface resistance of the transparent conductive layer produced by the above-mentioned methods is high, time-dependent changes, such as an increase in the surface resistance according to the change in the surroundings and time, or the like, are generated therein, such that initial conductivity may not be maintained. Therefore, this transparent conductive film has a limitation in being used as the transparent conductive layer due to low transmittance In addition, productivity may also decrease since the processes are complicated and various.

DISCLOSURE

Technical Problem

An object of the present invention is to provide a production method for a transparent conductive film capable of producing a transparent conductive film having excellent conductivity, transmittance, bending resistance, and adhesion and having low haze through a simple process, and a transparent conductive film produced thereby.

Technical Solution

In one general aspect, a production method for a transparent conductive film includes: a) forming an organic-inorganic hybrid transparent composite conductive layer containing transparent conductive oxide, a conductive metal body, and a conductive polymer as a step of forming a transparent composite conductive layer on a substrate; and b) drying and firing the transparent composite conductive layer.

In another general aspect, a production method for a transparent conductive film includes: a) forming a transparent composite conductive layer having a transparent conductive oxide layer and an organic-inorganic hybrid layer containing a conductive metal body and a conductive polymer that are formed regardless of the sequence, as a step of forming a transparent composite conductive layer on a substrate; and b) drying and firing the transparent composite conductive layer In another general aspect, a production method for a transparent conductive film includes: a) forming a transparent composite conductive layer including a transparent conductive oxide (TCO) layer; a conductive metal body layer; and a conductive polymer layer that are formed regardless of the sequence, as a step of forming a transparent composite conductive layer on a substrate; and b) drying and firing the transparent composite conductive layer.

In another aspect of the present invention, a transparent conductive film is produced by the method as described above.

Advantageous Effects

According to the present invention, a production method for a transparent conductive film capable of producing a transparent conductive film having excellent conductivity, transmittance, bending resistance, and adhesion and having low haze through a simple process, and a transparent conductive film produced thereby may be provided.

BEST MODE

A production method for a transparent conductive film according to a first exemplary embodiment of the present invention includes: a) forming an organic-inorganic hybrid transparent composite conductive layer containing transparent conductive oxide, a conductive metal body, and a conductive polymer as a step of forming a transparent composite conductive layer on a substrate; and b) drying and firing the transparent composite conductive layer.

Figure 1:
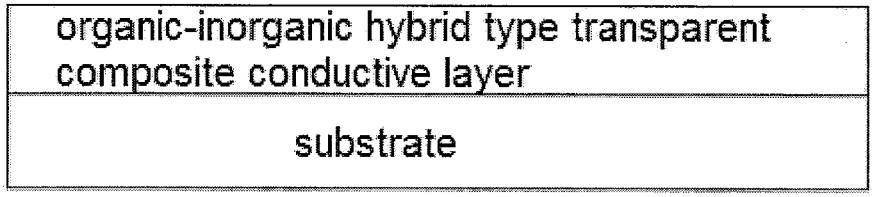
FIG. 1 is a schematic configuration diagram of a transparent conductive film according to a first exemplary embodiment of the present invention.

Therefore, the transparent conductive film according to the first exemplary embodiment of the present invention may be configured of the substrate and the organic-inorganic hybrid transparent composite conductive layer (the layer containing the transparent conductive oxide, the conductive metal body, and the conductive polymer) as shown in FIG. 1. The organic-inorganic hybrid transparent composite conductive layer may be provided in plural in a range in which transmittance may be secured.

As the substrate in step (a), various kinds of substrates may be used as long as a thin film or pattern may be easily formed by a coating or printing process.

For example, a transparent plastic film made of polyimide (PI), polyethylene terephthalate (PET), polyethylene naphthalate (PEN), polyether sulfone (PES), Nylon, polytetrafluoroethylene (PTFE), polyetheretherketone (PEEK), polycarbonate (PC), polyarylate (PAR), or the like, or a glass substrate is may be used. However, the kinds of substrate are not necessarily limited thereto.

In addition, the production method for a transparent conductive film according to the present invention may further include pre-treating the substrate before step (a).

More specifically, the substrate may be used after washing and degreasing or particularly, be subjected to pre-treatment. Examples of the pre-treatment include plasma treatment, ion beam treatment, corona treatment, oxidation or reduction treatment, heat treatment, etching treatment, ultraviolet (UV) radiation treatment, and primer treatment using binders or additives, but the present invention is not limited thereto.

In the organic-inorganic hybrid transparent composite conductive layer in step (a), the transparent conductive oxide may be contained therein in a flake shape or a nano-flake shape. The transparent conductive oxide may be added in the flake shape having a thickness of 900 nm or less and a diameter of 10 μm or less. The thickness and the diameter may be preferably 1 μm or less, and more preferably, 100 nm or less, but are not limited thereto.

Further, the conductive metal body may be contained in the organic-inorganic hybrid transparent composite conductive layer in a wire shape, a rod shape, or fiber shape. The conductive metal body having a diameter of 10 μm or less may be used. The diameter of the conductive metal body may be preferably 1 μm or less, and more preferably, 100 nm or less, but are not limited thereto.

The organic-inorganic hybrid transparent composite conductive layer in step (a) may be made of one-liquid type organic-inorganic hybrid solution containing the transparent conductive oxide, the conductive metal body, and the conductive polymer.

As an example, the organic-inorganic hybrid transparent composite conductive layer may be made of one-liquid type organic-inorganic hybrid solution containing a transparent conductive oxide solution, a conductive metal body solution, and a conductive polymer solution.

As a specific example, the organic-inorganic hybrid transparent composite conductive layer may be made of one-liquid type organic-inorganic hybrid solution containing a transparent conductive oxide dispersion solution, a conductive metal body aqueous solution, and a conductive polymer aqueous solution. However, the present invention is not limited thereto.

In the transparent conductive oxide dispersion solution, the transparent conductive oxide may be added in a flake shape having a thickness of 900 nm or less and a diameter of 10 μm or less and dispersed therein. The thickness and the diameter may be preferably 1 μm or less, and more preferably, 100 nm or less, but are not limited thereto.

The transparent conductive oxide dispersion solution may be prepared by mixing transparent conductive oxide flakes with a solvent to allow the transparent conductive oxide flakes to be uniformly dispersed in the solvent. In addition, a method of preparing nano-dispersions through a sol-gel synthetic method may be applied so that a wet coating method may be performed.

As a solvent in this case, any one of an organic or inorganic resin, alcohol, water, or an organic solvent, or a mixture thereof may be used. In this case, a binder and/or dispersant in addition to as the solvent may be further added.

Examples of the binder include a mixture of ethylhydroxylethylcellulose and an acrylic acid-acrylamide copolymer, a mixture of polyethylene oxide and polyvinylalcohol, an acrylic acid-methacrylic acid copolymer, an acrylic acid ester-methacrylic acid ester copolymer, an acrylic acid-acrylamide copolymer and a mixture of an acrylic acid-acrylamide copolymer and polyethylene oxide.

As the dispersant, an organic compound such as polycarboxylic acid or derivatives thereof may be mainly used. Examples of the polycarboxylic acid or the derivatives thereof may include a homopolymer and copolymer of acrylic acid salts or methacrylic acid salts such as alkali metal salts of acrylic acid or methacrylic acid; a homopolymer and copolymer of acrylic acid ester or methacrylic acid ester such as methyl acrylate, methyl methacrylate, ethyl acrylate, ethyl methacrylate, n-butyl acrylate, n-butyl methacrylate, isobutyl acrylate, or isobutyl methacrylate. However, the present invention is not limited thereto.

Further, in the transparent conductive oxide dispersion solution, a stabilizer, a thin film auxiliary agent, a binder resin, a surfactant, a wetting agent, a thixotropic agent, a leveling agent, and reducer may further be added in addition to the above-mentioned additives, as needed.

The transparent conductive oxide (TCO) means a material of which light transmittance is high and through which electricity flows.

As the transparent conductive oxide, for example, at least one selected from tin oxide ($SnO_2$), antimony tin oxide (ATO), fluoro tinoxide (FTO), zinc oxide (ZnO), aluminum zinc oxide, (AZO), Gallium Zinc Oxide (GZO), Boron Zinc Oxide (BZO), $SiO_2$—ZnO (SZO), indium oxide ($In2O_3$), Indium Tin Oxide (ITO), and Indium Zinc Oxide (IZO) may be used. Among them, ITO may be preferably used since it is easy to produce a transparent conductive film having low resistance using ITO, but the present invention is not limited thereto.

In the conductive metal body aqueous solution, the conductive metal body having a diameter of 10 μm or less may be contained. The diameter of the conductive metal body may be preferably 1 μm or less, and more preferably, 100 nm or less, but are not limited thereto. The conductive metal body having a wire shape, a rod shape, or fiber shape may be contained therein.

The conductive metal body in the conductive metal aqueous solution may be selected from a silver nano wire, a gold nano wire, and a gold-silver alloy nano wire.

More specifically, the silver nano wire capable of having excellent conductivity, cheap cost, and being mass produced may be preferably used. Although silver, which is a main material of the silver nano wire, is basically an opaque material, in the case in which a size of a silver wire is decreased in a unit of nano, silver becomes transparent. Particularly, in order to secure transparency in a visible ray region (400 to 700 nm), the silver nano wire needs to have a diameter or thickness of 100 nm or less. In view of conductivity, when the diameter of the silver nano wire is decreased to 10 nm or less since specific resistance of the silver nano wire rapidly increases, the diameter of the silver nano wire may be preferably 10 to 100 nm.

In the case of the silver nano wire, the silver nano wire is prepared mainly by a polyol reduction process of dissolving silver nitrate and polyvinylpyrrolidone in a solvent such as ethyleneglycol and heating and stirring the mixed solution to reduce silver. In addition, a silver nano wire water dispersion solution in a water dispersion state may be prepared.

As the conductive polymer in the conductive polymer solution, at least one selected from polyacetylene, polyaniline, polypyrrole, polythiophene, polysulfurnitride, polyphenylenesulfide, polyphenylene, polyfuran, polyphenylenevinylene, polythienylenevinylene, polyisothianaphthene, polyethylenedioxythiophene (PEDOT), and PEDOT/polystyrenesulfonate (PSS) may be used. Among them, PEDOT/PSS having excellent conductivity and transparency may be preferably used, but the present invention is not limited thereto.

The transparent conductive oxide dispersion solution, the conductive metal body aqueous solution, and the conductive polymer aqueous solution may be prepared by a method known in the art.

The one-liquid type organic-inorganic hybrid solution may further contain at least one selected from deionized water, an organic solvent, and a surfactant.

Examples of the organic solvent may include alcohols such as methanol, ethanol, isopropanol, butanol, glycols such as ethyleneglycol, glycerin, acetates such as ethylacetate, butylacetate, carbitolacetate, ethers such as diethylether, tetrahydrofuran, dioxan, ketones such as methylethylketone, acetone, hydrocarbons such as hexane, heptane, aromatics such as benzene, toluene, and halogen substitution solvent such as chloroform, methylenechloride, carbontetrachloride, or the mixture solvent thereof, but are not limited thereto.

As the surfactant, a non-ionic surfactant may be used. For example, the non-ionic surfactant may be selected from a group consisting of alkoxylated C4 to C22-alcohol, alkylpolyglucoside, N-alkylpolyglucoside, N-alkyl-glucamide, fatty acid alkoxylate, fatty acid polyglycol esters, fatty acid amine alkoxylate, arbitrarily terminal group-capped fatty acid amide alkoxylate, fatty acid alkanolamide alkoxylate, N-alkoxylpolyhydroxy-fatty acid amide, N-aryloxypolyhydroxy-fatty acid amide, polyisobutene/maleic acid anhydride derivatives, fatty acid glyceride, sorbitan ester, polyhydroxy-fatty acid derivatives, polyalkoxy fatty acid derivatives, and bisglyceride. As a specific example, a non-ionic surfactant such as Znoyl FSO (Dupont) may be preferably used. However, the surfactant is not limited thereto, but all of the non-ionic surfactants known in the art may be used.

The one-liquid type organic-inorganic hybrid solution may be prepared by processes of mixing the conductive metal body solution and the conductive polymer solution with the organic solvent; adding the transparent conductive oxide solution thereto to mix them; and adding the deionized water, the organic solvent, and the surfactant thereto and mixing them.

A method of forming the transparent composite conductive layer in step (a) using the one-liquid type organic-inorganic hybrid solution may be selected from a spin coating method, a roll coating method, a spray coating method, a dip coating method, a flow coating method, a doctor blade and dispensing method, an ink-jet printing method, an offset printing method, a screen printing method, a pad printing method, a gravure printing method, a flexography printing method, a stencil printing method, an imprinting method, a xerography method, and a lithography method.

The drying and firing in step (b) is performed by heat-treatment.

For example, the heat treatment may be generally performed at 80 to 400° C., preferably 90 to 300° C., and more preferably 100 to 150° C. Alternatively, the heat treatment may be performed in at least two steps at a low temperature and a high temperature within the above-mentioned range. For example, the heat treatment may be performed at 80 to 150° C. for 1 to 30 minutes and again at 150 to 300° C. for 1 to 30 minutes.

Hereinafter, in describing the second and third exemplary embodiments, detailed descriptions overlapped with those in the first embodiment will be omitted.

A production method for a transparent conductive film according to the second exemplary embodiment of the present invention includes: a) forming a transparent composite conductive layer having a transparent conductive oxide (TCO) layer and an organic-inorganic hybrid layer including a conductive metal body and a conductive polymer that are formed regardless of the sequence, as a step of forming a transparent composite conductive layer on a substrate; and b) drying and firing the transparent composite conductive layer.

The transparent conductive oxide layer may contain transparent conductive oxide flakes.

Figure 2:
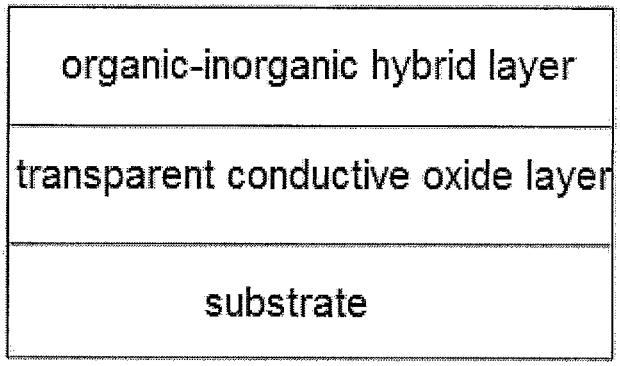
FIG. 2 is a schematic configuration diagram of a transparent conductive film according to a second exemplary embodiment of the present invention.

Therefore, as shown in FIG. 2, the transparent conductive film according to the second exemplary embodiment of the present invention may be configured of the substrate and the transparent composite conductive layer, wherein the transparent composite conductive layer may be configured of the transparent conductive oxide layer and the organic-inorganic hybrid layer (the layer containing the conductive metal body and the conductive polymer).

The sequence in which the transparent conductive oxide layer and the organic-inorganic hybrid layer are laminated is not limited to a sequence shown in FIG. 2, but the organic-inorganic hybrid layer may be laminated on the substrate, and the transparent conductive oxide layer may be laminated on the organic-inorganic hybrid layer. Further, the transparent conductive oxide layer and the organic-inorganic hybrid layer may be provided in plural, respectively, in a range in which the transmittance may be secured.

In the case in which the transparent conductive oxide layer and the organic-inorganic hybrid layer are sequentially laminated, before the organic-inorganic hybrid layer is formed on the transparent conductive oxide layer, cracking is performed on the transparent conductive oxide layer so as to form cracks therein, and then the organic-inorganic hybrid layer may be formed.

As the transparent conductive oxide layer is cracked in a flake shape when the transparent conductive oxide layer is cracked, the transparent conductive oxide layer may be formed as a transparent conductive oxide flake layer containing transparent conductive oxide flakes.

Here, the cracked transparent conductive oxide layer may have a thickness of more than 150 to 500 nm. Since the crack may be easily formed when the thickness of the transparent conductive oxide layer is more than 150 nm, in the case of requiring the crack, after the transparent conductive oxide layer may be formed so as to have this thickness range, and then the cracking may be performed.

Alternatively, the transparent conductive oxide layer may be made of the transparent conductive oxide solution, and the organic-inorganic hybrid layer may be made of the organic-inorganic hybrid solution prepared so as to contain the conductive metal body and the conductive polymer solution.

Here, the transparent conductive oxide solution may contain transparent conductive oxide flakes.

In addition, the conductive metal body solution may contain the conductive metal body having a wire shape, a rod shape, or fiber shape.

As an example, the transparent conductive oxide layer may be made of the transparent conductive oxide dispersion solution, and the organic-inorganic hybrid layer may be made of an organic-inorganic hybrid solution containing the conductive metal body aqueous solution and a conductive polymer aqueous solution.

Here, the organic-inorganic hybrid solution may further contain at least one selected from deionized water, an organic solvent, and a surfactant.

The organic-inorganic hybrid solution may be prepared by processes of mixing the conductive metal body solution and the conductive polymer solution with the organic solvent; and adding the deionized water, the organic solvent, and the surfactant thereto and mixing them.

In the case in which the organic-inorganic hybrid solution is coated on the transparent conductive oxide layer in which the cracks are formed, the solution may serve to secure conductivity and the transmittance while filling the cracks.

Unlike the second exemplary embodiment, regardless of the sequence on the substrate, a layer containing the conductive metal body and the transparent conductive oxide may be formed as a first layer and a conductive polymer layer may be formed as a second layer. Each of the layers may be formed in plural in a range in which the transmittance may be secured.

Alternatively, regardless of the sequence on the substrate, a conductive metal body layer is formed as a first layer, and a layer containing the conductive polymer and transparent conductive oxide may be formed as a second layer. Each of the layers may be formed in plural in a range in which the transmittance may be secured.

A production method for a transparent conductive film according to the third exemplary embodiment of the present invention includes: a) forming a transparent composite conductive layer including a transparent conductive oxide (TCO) layer; a conductive metal body layer; and a conductive polymer layer that are formed regardless of the sequence, as a step of forming a transparent composite conductive layer on a substrate; and b) drying and firing the transparent composite conductive layer.

The transparent conductive oxide layer may contain transparent conductive oxide flakes, and the conductive metal body layer may contain a conductive metal body having a wire shape, a rod shape, or fiber shape.

Figure 3:
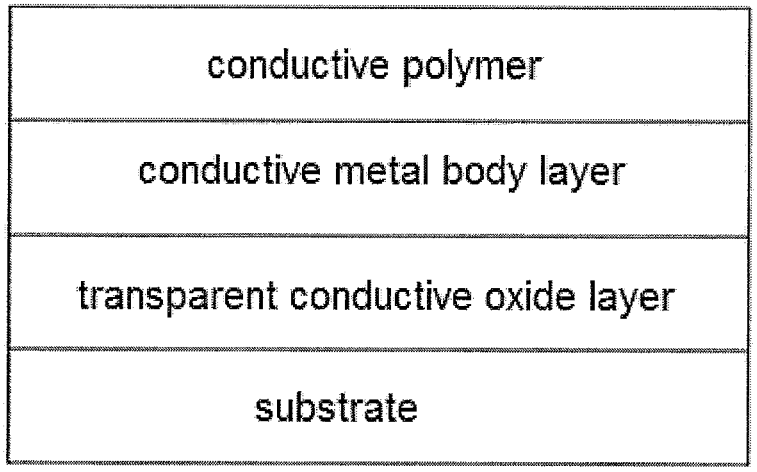
FIG. 3 is a schematic configuration diagram of a transparent conductive film according to a third exemplary embodiment of the present invention.

Therefore, as shown in FIG. 3, the transparent conductive film according to the third exemplary embodiment of the present invention may be configured of the substrate and the transparent composite conductive layer, wherein the transparent composite conductive layer may be configured of the transparent conductive oxide layer, the conductive metal body layer, and the conductive polymer layer.

A sequence in which the transparent conductive oxide layer, the conductive metal body layer, and the conductive polymer layer are laminated is not limited to a sequence shown in FIG. 3, but may be changed in various combinations.

Further, the transparent conductive oxide layer, the conductive metal body layer, and the conductive polymer layer may be provided in plural, respectively, in a range in which the transmittance may be secured.

In the case in which the transparent conductive oxide layer, the conductive metal body layer, and the conductive polymer layer are sequentially laminated, the transparent conductive oxide layer may be cracked, and then the conductive metal body layer may be formed on the cracked transparent conductive oxide layer.

As the transparent conductive oxide layer is cracked in a flake shape when the transparent conductive oxide layer is cracked, the transparent conductive oxide layer may be formed as a transparent conductive oxide flake layer containing transparent conductive oxide flakes.

In the case in which a conductive metal body solution to be described below is coated on the transparent conductive oxide layer in which the cracks are formed, the solution may serve to secure conductivity and the transmittance while filling the cracks.

Here, the cracked transparent conductive oxide layer may have a thickness of more than 150 to 500 nm. Since the crack may be easily formed when the thickness of the transparent conductive oxide layer is more than 150 nm, in the case of requiring the crack, after the transparent conductive oxide layer may be formed so as to have this thickness range, and then the cracking may be performed.

Alternatively, the transparent conductive oxide layer may be made of a transparent conductive oxide solution, the conductive metal body layer may be made of a conductive metal body solution, and the conductive polymer layer may be made of a conductive polymer solution.

In this case, the conductive metal body solution may contain a conductive metal body having a wire shape, a rod shape, or fiber shape.

Further, the transparent conductive oxide solution may contain transparent conductive oxide flakes.

As an example, the transparent conductive oxide layer may be made of a transparent conductive oxide dispersion solution, the conductive metal body layer may be made of a conductive metal body aqueous solution, and the conductive polymer layer may be made of a conductive polymer aqueous solution.

In this case, the transparent conductive oxide layer may have a thickness of 10 to 150 nm, the conductive metal body layer may have a thickness of 10 to 300 nm, and the conductive polymer layer may have a thickness of 10 to 300 nm. However, the present invention is not limited thereto.

In the transparent composite conductive layer according to the first to third exemplary embodiments of the present invention as described above, in order to improve the conductivity, carbon nano tube (CNT), carbon nano fiber (CNF), graphene may be further contained.

Hereinafter, the present invention will be described in detail through the Examples. However, the present invention is not limited thereto.

EXAMPLE 1

1) One-Liquid Type Organic-Inorganic Hybrid Solution

In a glass container, 5% silver nano wire (diameter: 30 nm, aspect ratio ≥1000) water dispersion solution (20 g) and 10%

PEDT:PSS aqueous solution (10 g) were mixed with methanol (20 g) and slowly stirred. 10% ITO flake (thickness: 20 nm, diameter 1 μm) dispersion solution (10 g) was added thereto and slowly stirred. Deionized water (10 g), methanol (30 g), Zonyl FSO (0.01 g) were added thereto and slowly stirred, thereby obtaining one-liquid type organic-inorganic hybrid solution.

2) Pretreatment of Transparent Substrate

As a substrate for a transparent conductive film, SH82 (PET film, SKC.) was used, and in order to increase hydrophilicity, atmospheric pressure plasma processing was performed. A flow amount of nitrogen was adjusted to 2001 pm, a flow amount of oxygen was adjusted to 41 pm, plasma discharge power was adjusted to 12 kw, such that plasma processing was performed at a rate of 10 mm/s. A contact angle was 35° based on an integer.

3) Production of Transparent Conductive Layer

The one-liquid organic-inorganic hybrid solution was applied onto the PET film pre-treated as the substrate by a spin coating method. The spin coating was performed at 1000 rpm for 5 seconds, and drying and firing was performed in a convection oven at 150° C. for 3 minutes. Therefore, a transparent conductive film configured of the PET film and the organic-inorganic hybrid transparent composite conductive layer was obtained (See FIG. 1).

EXAMPLE 2

1) Transparent Conductive Oxide Dispersion Solution and Organic-Inorganic Hybrid Solution In order to form a transparent conductive oxide layer, 10% ITO nano flake (thickness: 20 nm, diameter: 1 μm) dispersion solution (10 g) equal to that in Example 1 was prepared.

In order to form an organic-inorganic hybrid layer, in a glass container, after 5% silver nano wire (diameter: 30 nm, aspect ratio ≥1000) water dispersion solution (20 g) and 10% PEDT:PSS aqueous solution (10 g) were mixed with methanol (20 g) and slowly stirred, deionized water (10 g), methanol (40 g), Zonyl FSO (0.01 g) were added thereto and slowly stirred, thereby obtaining the organic-inorganic hybrid solution.

2) Substrate for Transparent Conductive Film

As a substrate for a transparent conductive film, SH82 (PET film, SKC.) was used, and in order to increase hydrophilicity, atmospheric pressure plasma processing was performed. A flow amount of nitrogen was adjusted to 2001 pm, a flow amount of oxygen was adjusted to 41 pm, plasma discharge power was adjusted to 12 kw, such that plasma processing was performed at a rate of 10 mm/s. A contact angle was 35° based on an integer.

3) Production of Transparent Conductive Layer

10% ITO nano flake (thickness: 20 nm, diameter: 1 μm) dispersion solution for forming the transparent conductive oxide layer and the organic-inorganic hybrid solution for forming the organic-inorganic hybrid layer were sequentially applied onto the PET film pre-treated as the substrate by the spin coating method. The spin coating was performed at 1000 rpm for 5 seconds, and drying and firing was performed in a convection oven at 150° C. for 3 minutes. Therefore, a transparent conductive film configured of the PET film, the transparent conductive oxide layer, and the organic-inorganic hybrid layer was obtained (See FIG. 2).

EXAMPLE 3

1) Preparation of Transparent Conductive Oxide Dispersion Solution, Conductive Metal Body Aqueous Solution, and Conductive Polymer Aqueous Solution 10% ITO nano flake (thickness: 20 nm, diameter: 1 μm) dispersion solution the same as that in Example 1, 5% silver nano wire (diameter: 30 nm, aspect ratio ≥1000) water dispersion solution, and 10% PEDT:PSS aqueous solution were prepared, respectively.

2) Substrate for Transparent Conductive Film

As a substrate for a transparent conductive film, SH82 (PET film, SKC.) was used, and in order to increase hydrophilicity, atmospheric pressure plasma processing was performed. A flow amount of nitrogen was adjusted to 2001 pm, a flow amount of oxygen was adjusted to 41 pm, plasma discharge power was adjusted to 12 kw, such that plasma processing was performed at a rate of 10 mm/s. A contact angle was 35° based on an integer.

3) Production of Transparent Conductive Layer

10% ITO nano flake (thickness: 20 nm, diameter: 1 μm) dispersion solution for forming a transparent conductive oxide layer, 5% silver nano wire (diameter: 30 nm, aspect ratio ≥1000) water dispersion solution for forming a conductive metal body layer, and 10% PEDT:PSS aqueous solution for forming a conductive polymer layer were sequentially applied onto the PET film pre-treated as the substrate by the spin coating method. The spin coating was performed at 1000 rpm for 5 seconds, and drying and firing was performed in a convection oven at 150° C. for 3 minutes. Therefore, a transparent conductive film configured of the PET film, the transparent conductive oxide layer, the conductive metal body layer, and the conductive polymer layer was obtained (See FIG. 3).

The invention claimed is:

1. A production method for a transparent conductive film, the production method comprising:

(a) forming a transparent conductive oxide (TCO) layer on a substrate, cracking the transparent conductive oxide layer, and forming an organic-inorganic hybrid layer containing a conductive metal body and a conductive polymer on the cracked transparent conductive oxide layer to produce a transparent composite conductive layer; and (b) drying and firing the transparent composite conductive layer.

2. The production method of claim 1, wherein the transparent conductive oxide layer is cracked in a flake shape when the transparent conductive oxide layer is cracked, such that the transparent conductive oxide layer is formed as a transparent conductive oxide flake layer containing transparent conductive oxide flakes.

3. The production method of claim 1, wherein the transparent conductive oxide layer is made of a transparent conductive oxide solution, and the organic-inorganic hybrid layer is made of an organic-inorganic hybrid solution containing a conductive metal body solution and a conductive polymer solution.

4. The production method of claim 3, wherein the organic-inorganic hybrid solution further includes at least one kind selected from deionized water, an organic solvent, and a surfactant.

5. The production method of claim 4, wherein the organic-inorganic hybrid solution is prepared by the steps of mixing the conductive metal body solution and the conductive polymer solution with the organic solvent; and adding the deionized water, the organic solvent, and the surfactant thereto and mixing them.

* * * * *